US011575993B2

(12) United States Patent
Li et al.

(10) Patent No.: US 11,575,993 B2
(45) Date of Patent: Feb. 7, 2023

(54) SPEAKER AND SPEAKER MODULE

(71) Applicant: Goertek Inc., Shandong (CN)

(72) Inventors: Changlong Li, Shandong (CN); Jianxin Wang, Shandong (CN); Cuili Zhang, Shandong (CN); Yong Li, Shandong (CN); Zhixin Sang, Shandong (CN)

(73) Assignee: Goertek Inc., Weifang (CN)

( * ) Notice: Subject to any disclaimer, the term of this patent is extended or adjusted under 35 U.S.C. 154(b) by 29 days.

(21) Appl. No.: 17/256,704

(22) PCT Filed: Dec. 21, 2018

(86) PCT No.: PCT/CN2018/122705
§ 371 (c)(1),
(2) Date: Dec. 29, 2020

(87) PCT Pub. No.: WO2020/000937
PCT Pub. Date: Jan. 2, 2020

(65) Prior Publication Data

US 2021/0266674 A1 Aug. 26, 2021

(30) Foreign Application Priority Data

Jun. 29, 2018 (CN) ..... 201810717207.9

(51) Int. Cl.
*H04R 9/06* (2006.01)
*H04R 9/02* (2006.01)
*H04R 7/02* (2006.01)

(52) U.S. Cl.
CPC ..... *H04R 9/06* (2013.01); *H04R 9/025* (2013.01); *H04R 7/02* (2013.01); *H04R 2400/11* (2013.01)

(58) Field of Classification Search
CPC . H04R 9/06; H04R 9/025; H04R 7/02; H04R 2400/11
See application file for complete search history.

(56) References Cited

U.S. PATENT DOCUMENTS

2013/0094685 A1* 4/2013 Seo ..... H04R 1/021 381/332

FOREIGN PATENT DOCUMENTS

CN 103052017 A 4/2013
CN 204733373 U * 10/2015
(Continued)

*Primary Examiner* — Alexander Krzystan
*Assistant Examiner* — Julie X Dang
(74) *Attorney, Agent, or Firm* — Baker Botts LLP

(57) ABSTRACT

An embodiment relates to a speaker and a speaker module. The speaker comprises a vibration system and a magnetic circuit system; the vibration system comprises a diaphragm and a voice coil coupled to the diaphragm; a space between a front side of the diaphragm and a front sound cavity cover forms a front sound cavity, and a space between a back side of the diaphragm and a rear sound cavity cover forms a rear sound cavity; wherein the speaker further comprises a plurality of injection molding inserts disposed along a vibration direction of the diaphragm, and the injection molding insert comprises a first end and a second end; the first end is joined with a surface of the front sound cavity cover close to the diaphragm, and the second end is joined with a surface of the rear sound cavity cover close to the diaphragm. One technical problem to be solved by the embodiment of the present invention is to ensure, by using the injection molding inserts, the stability of relative distance and parallelism of the diaphragm connection surface of the housing with respect to both the front sound cavity support surface and the rear sound cavity support surface, so as to ensure stability of the acoustic performance of the speaker.

9 Claims, 3 Drawing Sheets

(56) References Cited

FOREIGN PATENT DOCUMENTS

| | | | |
|---|---|---|---|
| CN | 105491489 | A | 4/2016 |
| CN | 105578364 | A | 5/2016 |
| CN | 205283807 | U | 6/2016 |
| CN | 108810762 | A | 11/2018 |

* cited by examiner

SPEAKER AND SPEAKER MODULE

CROSS-REFERENCE TO RELATED APPLICATIONS

This application is a National Stage of International Application No. PCT/CN2018/122705, filed on Dec. 21, 2018, which claims priority to Chinese Patent Application No. 201810717207.9, filed on Jun. 29, 2018, both of which are hereby incorporated by reference in their entireties.

TECHNICAL FIELD

The present invention belongs to the technical field of electro-acoustic conversion devices. Specifically, the present invention relates to a speaker and a speaker module.

BACKGROUND

The existing speaker generally includes a housing and a sound generating system arranged in the housing. The parts connecting the sound generating system and the housing include a diaphragm, a front sound cavity cover, a rear sound cavity cover, and the like. The housing of the existing speaker is generally made from plastic material through an injection molding process. Before the injection molding, the volume of the front sound cavity and the volume of the rear sound cavity are limited by providing a plastic pallet.

However, when the plastic pallet and the housing are injection molded, the housing is prone to warpage and deformation (warpage means that the plastic part is not formed according to the designed shape, but the surface is twisted. The warpage of the plastic part is attributed to the uneven shrinkage of the formed plastic part), the warpage and deformation will cause the relative distance between the connection surface of each sound cavity cover on the housing and the connection surface of the diaphragm to be unstable, and ultimately lead to unstable acoustic performance of the speaker.

SUMMARY

An object of the present invention is to provide a solution to ensure the stability of the relative distance and parallelism of the diaphragm connection surface of the housing with respect to the front sound cavity support surface and the rear sound cavity support surface.

According to an aspect of the present invention, a speaker is provided, comprising: a vibration system and a magnetic circuit system matched with the vibration system; the vibration system comprises a diaphragm and a voice coil coupled to the diaphragm; a space between a front side of the diaphragm and a front sound cavity cover forms a front sound cavity, and a space between a back side of the diaphragm and a rear sound cavity cover forms a rear sound cavity; wherein the speaker further comprises a plurality of injection molding inserts disposed along a vibration direction of the diaphragm, and the injection molding insert comprises a first end and a second end which are oppositely disposed; the first end is joined with a surface of the front sound cavity cover close to the diaphragm, and the second end is joined with a surface of the rear sound cavity cover close to the diaphragm.

Optionally, the speaker comprises a housing accommodating the vibration system and the magnetic circuit system, and a front cover assembled with the housing; the front sound cavity cover is a front cover of the speaker; a bottom surface of the housing has an opening, and the magnetic circuit system comprises a magnetic conductive yoke which is assembled at the opening of the bottom surface of the housing as the rear sound cavity cover.

Optionally, the first end of the injection molding insert is a front sound cavity support surface, and the second end is the rear sound cavity support surface; the speaker further comprises a diaphragm connection surface arranged between the first end and the second end, and the diaphragm is connected and fixed on the diaphragm connection surface.

Optionally, the injection molding insert is a rigid injection molding insert, and the injection molding insert comprises an insert body and a support plate; wherein, the insert body comprises a first inlay and a second inlay;

and both the front sound cavity support surface and the rear sound cavity support surface are perpendicular to an axis of the insert body.

Optionally, the insert body is an integral structure;

the support plate completely encircles an outer circumference of the insert body and is connected to an outer side wall of the insert body, a surface of the support plate towards the front sound cavity support surface is the diaphragm connection surface, and the diaphragm connection surface is parallel to the front sound cavity support surface.

Optionally, the insert body is a split structure;

one end of the first inlay is connected with the support plate, and the other end of the first inlay is the front sound cavity support surface; and one end of the second inlay is connected with the support plate, and the other end of the second inlay is the front sound cavity support surface.

Optionally, a rough structure is provided on the insert body;

the rough structure is located on the first inlay and/or the second inlay; wherein the rough structure comprises a spiral structure, a continuous convex-concave structure and an irregular pattern.

Optionally, the housing is obtained by pre-embedding the injection molding insert and then through injection molding.

Optionally, the housing is of a rectangular structure;

and there are four injection molding inserts which are arranged at four corners of the housing, respectively.

The present invention further provides a speaker module, comprising: a module shell and the speaker as described above;

wherein the speaker is arranged in the module shell, the module shell has a sound outlet, and a sound emitted by the speaker is capable of being transmitted from the sound outlet.

A technical effect of the embodiment of the present invention is that a plurality of injection molding inserts are arranged in the housing, and the front sound cavity support surface, the rear sound cavity support surface and the diaphragm connection surface of the injection molding insert are used to connect with the front sound cavity cover, the rear sound cavity cover and the vibration system accommodated in the housing. The injection molding inserts will not be warped and deformed after the injection molding, which can ensure the stability of the relative distance and parallelism of the diaphragm connection surface of the housing with respect to both the front sound cavity support surface and the rear sound cavity support surface, so as to ensure stability of the acoustic performance of the speaker.

Other features and advantages of the invention will become clear from the following detailed description of exemplary embodiments of the invention with reference to the drawings.

BRIEF DESCRIPTION OF THE DRAWINGS

The drawings that form a part of the description describe embodiments of the invention and together with the description serve to explain the principles of the invention.

DRAWING REFERENCE SIGNS

Figure 1:
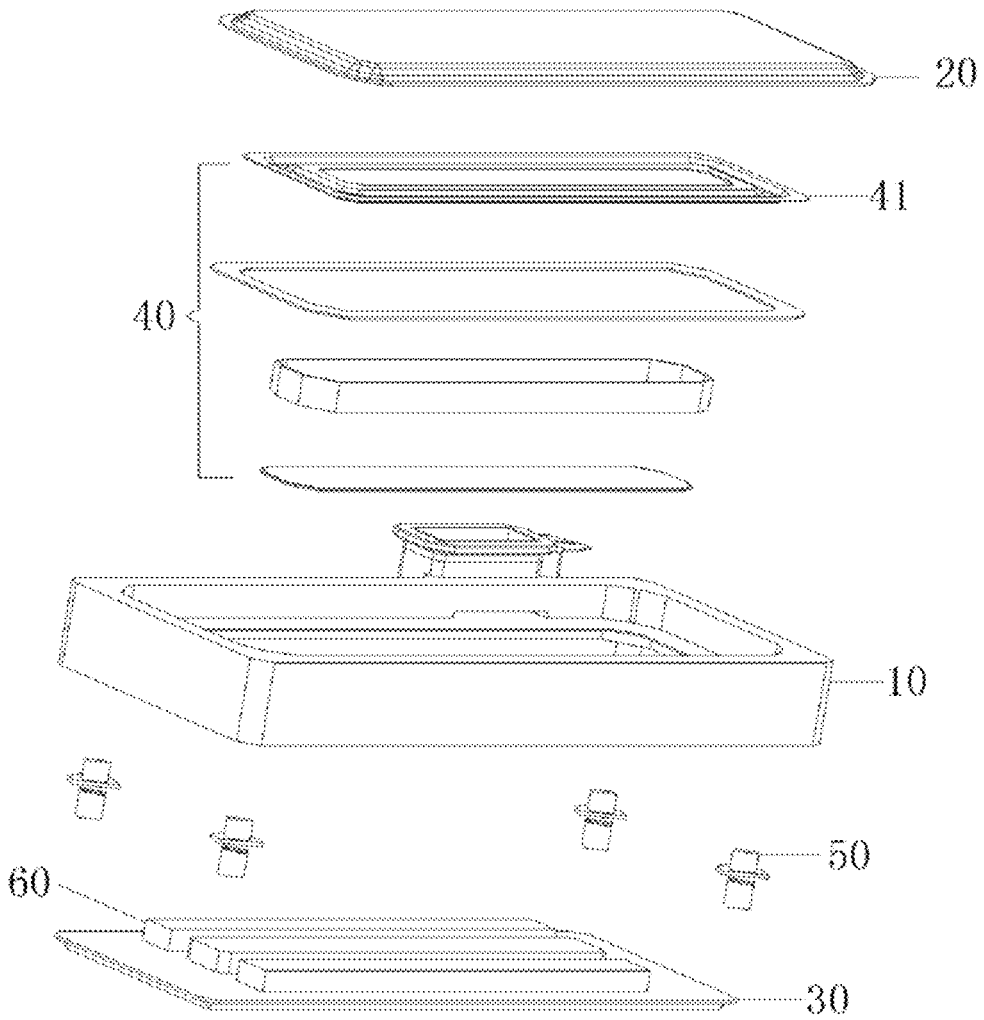
FIG. 1 is an exploded schematic structure diagram of a speaker in an embodiment of the present invention.

10: housing; 20: front sound cavity cover; 30: rear sound cavity cover; 40: vibration system; 41: diaphragm; 50: injection molding insert; 51: front sound cavity support surface; 52: rear sound cavity support surface; 53: diaphragm connection surface; 54: insert body; 541: first inlay; 542: second inlay; 55: support plate; 56: rough structure; 60: magnetic circuit system.

DETAILED DESCRIPTION

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

Techniques and devices known to those of ordinary skill in the related art may not be discussed in detail, but where appropriate, the techniques and devices should be considered as part of the description.

In all examples shown and discussed herein, any specific values should be interpreted as exemplary only and not as limitations. Therefore, other examples of the exemplary embodiment may have different values.

It should be noted that similar reference numerals and letters indicate similar items in the following drawings, and therefore, once an item is defined in one drawing, it does not need to be discussed further in subsequent drawings.

Figure 2:
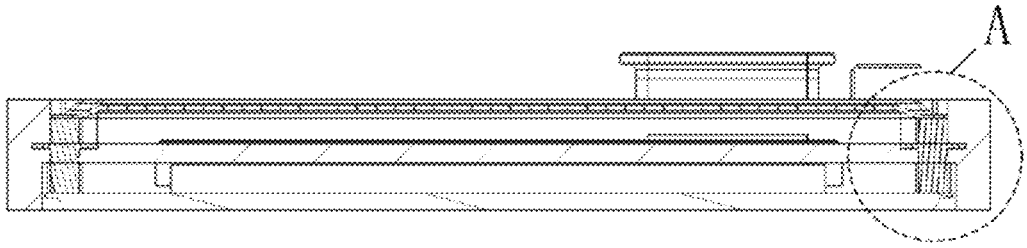
FIG. 2 is a cross-sectional schematic structure diagram of a speaker in an embodiment of the present invention.
Figure 3:
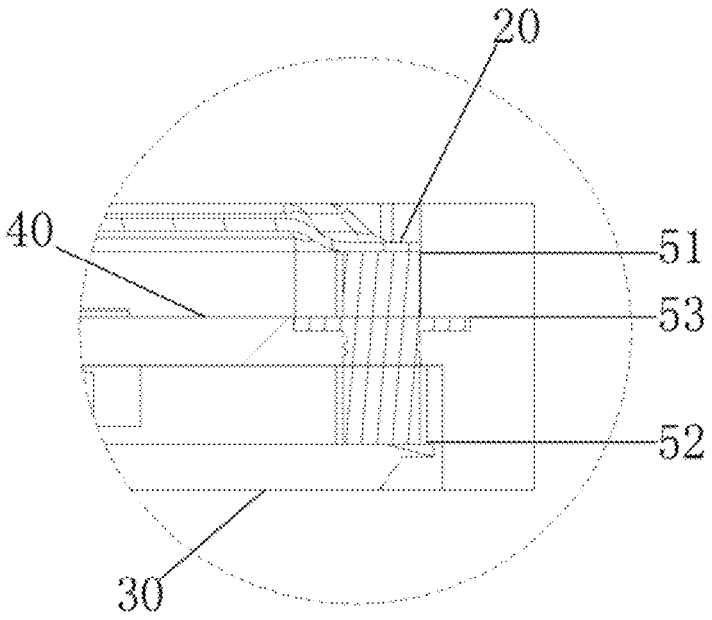
FIG. 3 is an enlarged view of A in FIG. 2.

Referring to FIGS. 1 to 3, the present invention provides a speaker comprising: a vibration system 40 and a magnetic circuit system 60 matched with the vibration system 40.

The vibration system 40 includes a diaphragm 41 and a voice coil coupled to the diaphragm; a space between a front side of the diaphragm 41 and the front sound cavity cover 20 forms a front sound cavity, and a space between a back side of the diaphragm 41 and the back sound cavity cover 30 forms the back sound cavity.

The speaker further comprises a plurality of injection molding inserts 50 arranged along a vibration direction of the diaphragm 41. The injection molding insert 50 comprises a first end and a second end which are disposed oppositely. The first end is joined with a surface of the front sound cavity cover 20 close to the diaphragm 41, and the second end is joined with a surface of the rear sound cavity cover 30 close to the diaphragm 41.

The speaker comprises a housing 10 accommodating the vibration system 40 and the magnetic circuit system 60, and a front cover assembled with the housing 10; the front sound cavity cover 20 is a front cover of the speaker; a bottom surface of the housing 10 has an opening, and the magnetic circuit system 60 comprises a magnetic conductive yoke which is assembled at the opening of the bottom surface of the housing 10 as the rear sound cavity cover 30.

The first end of the injection molding insert 50 is a front sound cavity support surface 51, and the second end is the rear sound cavity support surface 52; the speaker further comprises a diaphragm connection surface 53 arranged between the first end and the second end, and the diaphragm 41 is connected and fixed on the diaphragm connection surface 53.

A technical effect of the embodiment of the present invention is that a plurality of injection molding inserts 50 are arranged in the housing 10, and the front sound cavity support surface 51, the rear sound cavity support surface 52 and the diaphragm connection surface 53 of the injection molding insert 50 are used to connect with the front sound cavity cover 20, the rear sound cavity cover 30 and the vibration system 40 accommodated in the housing 10. The injection molding inserts 50 will not be warped and deformed after the injection molding, which can ensure the stability of the relative distance and parallelism of the diaphragm connection surface 53 of the housing 10 with respect to the front sound cavity support surface 51 and the rear sound cavity support surface 52, so as to ensure the stability of the acoustic performance of the speaker.

The speaker provided by the embodiment of the present invention will be further described in detail below.

In the embodiment of the present invention, the injection molding insert 50 is a rigid injection molding insert. The rigid injection molding inserts may be supported by metal materials. Compared with the plastic pallets in the prior art, the rigid injection molding inserts supported by metal materials have a higher processing precision and smaller flatness error during processing, and will not warp and deform and shrink the housing 10 after the housing 10 is injection molded, thereby ensuring the stability of the relative distance and parallelism of the diaphragm connection surface 53 of the housing 10 with respect to the front sound cavity support surface 51 and the rear sound cavity support surface 52.

The injection molding parts provided in the embodiments of the present invention may be achieved in a plurality of ways. An achievable way is that, referring to FIG. 4, optionally, an injection molding insert 50 includes an insert body 54 and a support plate 55, and the insert body comprises a first inlay 541 and a second inlay 542. The opposite ends of the insert body 54 are the front sound cavity support surface 51 and the rear sound cavity support surface 52. Both the front sound cavity support surface 51 and the rear sound cavity support surface 52 are perpendicular to the axis of the insert body 54. That is to say, the front sound cavity support surface 51 and the rear sound cavity support surface 52 are parallel to each other.

Optionally, the insert body 54 is an integral structure. The support plate 55 completely encircles an outer circumference of the insert body 54 and is connected to an outer side wall of the insert body 54, a surface of the support plate 55 towards the front sound cavity support surface 51 is the diaphragm connection surface 53, and the diaphragm connection surface 53 is parallel to the front sound cavity support surface 51. That is to say, the front sound cavity support surface 51, the rear sound cavity support surface 52 and the diaphragm connection surface 53 are parallel to each other. The diaphragm connection surface 53 and the diaphragm 41 may be connected by an adhesive layer.

Further, in order to ensure that the speaker will not be polarized, the front sound cavity support surfaces 51 of the plurality of injection molding inserts 50 in the housing 10 are in the same plane, and in turn the plurality of rear sound cavity support surfaces 52 are in the same plane and the plurality of diaphragm connection surfaces 53 are in the same plane. The relative distances of the front sound cavity cover 20, the rear sound cavity cover 30 and the diaphragm 41 are stable and the same, thereby ensuring that the speaker will not be polarized and ensuring the acoustic performance of the speaker.

Figure 4:
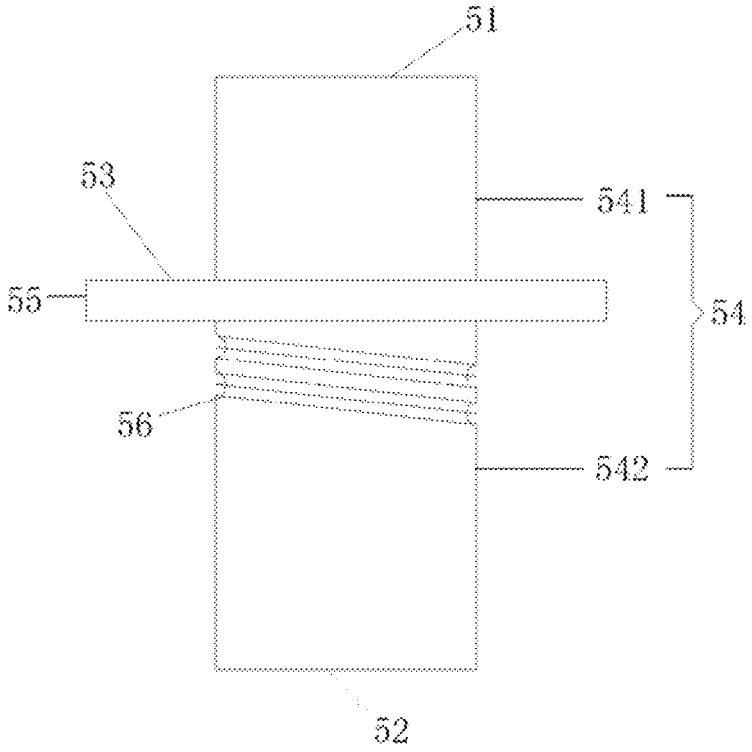
FIG. 4 is a schematic structure diagram of an injection molding insert in an embodiment of the present invention.

Continue to refer to FIG. 4, another achievable way for the injection molding insert 50 is that, optionally, the insert body 54 has a split structure. The insert body 54 comprises a first inlay 541 and a second inlay 542. The difference between this way and the previous way is that the insert body 54 has a split structure. One end of the first inlay 541 is connected with the support plate 55, and the other end of the first inlay 541 is the front sound cavity support surface 51. One end of the second inlay 542 is connected with the support plate 55, and the other end of the second inlay 542 is the front sound cavity support surface 51. Both the front sound cavity support surface 51 and the rear sound cavity support surface 52 are perpendicular to an axis of the insert body 54, and the diaphragm connection surface 53 is parallel to the front sound cavity support surface 51.

Continuing to refer to FIG. 4, in order to enhance the connection area between the housing 10 and the injection molding insert 50, in the embodiment of the present invention, optionally, a rough structure 56 is provided on the insert body 54. The rough structure 56 enhances the connection area between the housing 10 and the injection molding insert 50, which makes the connection between the housing and the injection molding insert stronger, and enhances the air tightness of the housing 10, thus reducing potential air tightness risks. The location of the rough structure 56 can be set based on different connection strength requirements. The rough structure 56 is located on the first inlay 541 and/or the second inlay 542. The rough structure 56 shown in FIG. 4 is located on the second inlay 542.

In the embodiment of the present invention, the rough structure 56 may be implemented in a plurality of ways. Optionally, the rough structure 56 comprises a spiral structure, a continuous convex-concave structure and an irregular pattern. Of course, the rough structure 56 also comprises other forms, which are not introduced here.

In the embodiment of the present invention, an implementation solution for the housing 10 is that the housing 10 is obtained by pre-embedding the injection molding insert 50 and then through injection molding. For example, before the injection molding, the injection molding inserts 50 are preset at the four corners of the housing 10, and the housing 10 is obtained through the injection molding process. There are four injection molding inserts 50 in the housing 10 at this time.

Figure 5:
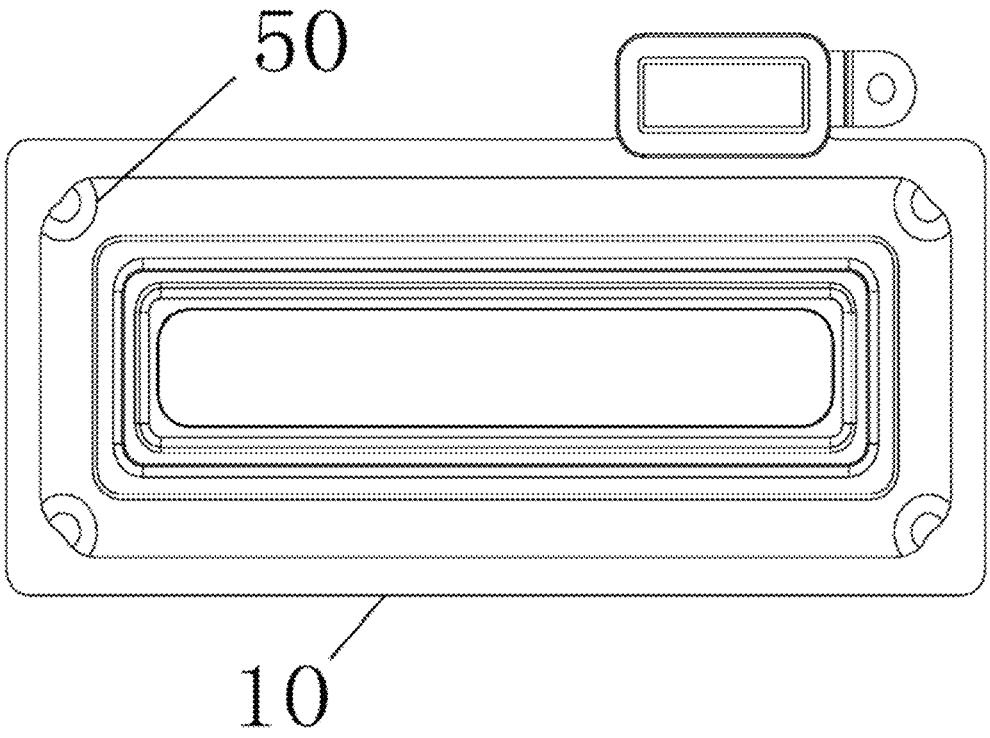
FIG. 5 is a schematic diagram of the distribution of injection molding inserts in an embodiment of the present invention.

The housing 10 can be designed in different shapes according to different requirements, such as rectangular, circular, or the like. According to different shapes of the housing 10, the positions of the injection molding inserts 50 are different. For example, as shown in FIG. 5, the housing 10 is of a rectangular structure, and there are four injection molding inserts 50, which are respectively arranged at the four corners of the housing 10. The housing 10 may be of a rectangular structure, and when there are a plurality of injection molding inserts 50, the plurality of injection molding inserts 50 may be symmetrically arranged along a symmetry axis in the length direction and/or the symmetry axis in the width direction of the housing 10. For another example, the housing 10 may also be of a circular structure, and there are a plurality of injection molding inserts 50, which are evenly distributed on the inner side wall of the housing 10.

In the embodiment of the present invention, according to different forms of speakers, the front sound cavity cover 20 is implemented in different ways. For example, the speaker is in the form of side sound generation, and the sound outlet of the speaker is arranged on the side wall of the housing 10. The front sound cavity cover 20 may be a steel sheet to prevent sound from being transmitted from above.

Further, the embodiment of the present invention further provides a speaker module, comprising: a module shell and the speaker as described above;

wherein the speaker is arranged in the module shell, the module shell has a sound outlet, and a sound emitted by the speaker is capable of being transmitted from the sound outlet.

Although some specific embodiments of the invention have been demonstrated in detail by way of examples, it should be understood by a person skilled in the art that the above examples are only intended to be illustrative but not to limit the scope of the invention. It should be understood by a person skilled in the art that the above embodiments can be modified without departing from the scope and spirit of the present invention. The scope of the present invention is defined by the attached claims.

The invention claimed is:

1. A speaker, comprising a vibration system and a magnetic circuit system matched with the vibration system;

the vibration system comprises a diaphragm and a voice coil coupled to the diaphragm; a space between a front side of the diaphragm and a front sound cavity cover forms a front sound cavity, and a space between a back side of the diaphragm and a rear sound cavity cover forms a rear sound cavity;

wherein the speaker further comprises a plurality of injection molding inserts disposed along a vibration direction of the diaphragm, and the injection molding insert comprises a first end and a second end which are oppositely disposed; the first end is joined with a surface of the front sound cavity cover close to the diaphragm, and the second end is joined with a surface of the rear sound cavity cover close to the diaphragm;

wherein the injection molding insert further comprises a support plate, and the support plate comprises a diaphragm connection surface arranged between the first end and the second end, and the diaphragm is connected and fixed on the diaphragm connection surface;

wherein the first end of the injection molding insert is a front sound cavity support surface, and the second end is a rear sound cavity support surface;

wherein the injection molding insert is a rigid injection molding insert, and the injection molding insert comprises an insert body; wherein, the insert body comprises a first inlay and a second inlay; and both the front sound cavity support surface and the rear sound cavity support surface are perpendicular to an axis of the insert body;

wherein the insert body is an integral structure; the support plate completely encircles an outer circumference of the insert body and is connected to an outer side wall of the insert body, a surface of the support plate towards the front sound cavity support surface is the diaphragm connection surface, and the diaphragm connection surface is parallel to the front sound cavity support surface; and wherein a rough structure is provided on the insert body; the rough structure is located on the first inlay and/or the second inlay; wherein the rough structure comprises a spiral structure, a continuous convex-concave structure and an irregular pattern.

2. The speaker according to claim 1, further comprising a housing accommodating the vibration system and the magnetic circuit system, and a front cover assembled with the housing; the front sound cavity cover is a front cover of the speaker; a bottom surface of the housing has an opening, and the magnetic circuit system comprises a magnetic conductive yoke which is assembled at the opening of the bottom surface of the housing as the rear sound cavity cover.

3. The speaker according to claim 1, wherein the housing is obtained by pre-embedding the injection molding insert and then through injection molding.

4. The speaker according to claim 1, wherein the housing is of a rectangular structure;

and there are four injection molding inserts which are arranged at four corners of the housing, respectively.

5. A speaker module, comprising: a module shell and the speaker according to claim 1;

wherein the speaker is arranged in the module shell, the module shell has a sound outlet, and a sound emitted by the speaker is capable of being transmitted from the sound outlet.

6. A speaker, comprising a vibration system and a magnetic circuit system matched with the vibration system;

the vibration system comprises a diaphragm and a voice coil coupled to the diaphragm; a space between a front side of the diaphragm and a front sound cavity cover forms a front sound cavity, and a space between a back side of the diaphragm and a rear sound cavity cover forms a rear sound cavity;

wherein the speaker further comprises a plurality of injection molding inserts disposed along a vibration direction of the diaphragm, and the injection molding insert comprises a first end and a second end which are oppositely disposed; the first end is joined with a surface of the front sound cavity cover close to the diaphragm, and the second end is joined with a surface of the rear sound cavity cover close to the diaphragm;

wherein the injection molding insert further comprises a support plate, and the support plate comprises a diaphragm connection surface arranged between the first end and the second end, and the diaphragm is connected and fixed on the diaphragm connection surface;

wherein the first end of the injection molding insert is a front sound cavity support surface, and the second end is a rear sound cavity support surface;

wherein the injection molding insert is a rigid injection molding insert, and the injection molding insert comprises an insert body; wherein, the insert body comprises a first inlay and a second inlay; and both the front sound cavity support surface and the rear sound cavity support surface are perpendicular to an axis of the insert body;

wherein the insert body is a split structure; one end of the first inlay is connected with the support plate, and the other end of the first inlay is the front sound cavity support surface; and one end of the second inlay is connected with the support plate, and the other end of the second inlay is the front sound cavity support surface; and wherein a rough structure is provided on the insert body; the rough structure is located on the first inlay and/or the second inlay; wherein the rough structure comprises a spiral structure, a continuous convex-concave structure and an irregular pattern.

7. The speaker according to claim 6, further comprising a housing accommodating the vibration system and the magnetic circuit system, and a front cover assembled with the housing; the front sound cavity cover is a front cover of the speaker; a bottom surface of the housing has an opening, and the magnetic circuit system comprises a magnetic conductive yoke which is assembled at the opening of the bottom surface of the housing as the rear sound cavity cover.

8. The speaker according to claim 6, wherein the housing is obtained by pre-embedding the injection molding insert and then through injection molding.

9. The speaker according to claim 6, wherein the housing is of a rectangular structure;

and there are four injection molding inserts which are arranged at four corners of the housing, respectively.

* * * * *